US007849821B2

(12) United States Patent
Peart et al.

(10) Patent No.: US 7,849,821 B2
(45) Date of Patent: Dec. 14, 2010

(54) BURNER FLASHBACK DETECTION AND SYSTEM SHUTDOWN APPARATUS

(75) Inventors: Jacob A. Peart, Wetumpka, AL (US); Gary A. Elder, Montgomery, AL (US); William J. Hall, Prattville, AL (US); William T. Harrigill, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 870 days.

(21) Appl. No.: 11/734,648

(22) Filed: Apr. 12, 2007

(65) Prior Publication Data

US 2008/0251035 A1 Oct. 16, 2008

(51) Int. Cl.
*F24H 1/20* (2006.01)

(52) U.S. Cl. ..... 122/18.3; 122/14.2; 122/14.31; 122/14.1; 431/21; 431/22

(58) Field of Classification Search ..... 122/18.3, 122/14.2, 14.31, 14.1; 431/2, 21, 22, 42, 431/77; 137/72

See application file for complete search history.

(56) References Cited

U.S. PATENT DOCUMENTS

| | | | |
|---|---|---|---|
| 1,423,080 | A | 7/1922 | Chausse |
| 1,609,134 | A | 11/1926 | Sladky et al. |
| 1,687,983 | A | 10/1928 | Klees et al. |
| 2,468,250 | A | 4/1949 | White et al. |
| 2,659,426 | A | 11/1953 | Rowell |
| 2,729,221 | A | 1/1956 | Gorham et al. |
| 2,776,000 | A | 1/1957 | Miller |
| 2,870,827 | A | 1/1959 | Brockbank |
| 3,112,788 | A | 12/1963 | Dunston |
| 3,469,569 | A | 9/1969 | Brockbank |
| 3,680,999 | A | 8/1972 | Hill |
| 3,800,816 | A | 4/1974 | Follett |
| 4,060,371 | A | 11/1977 | Gentry et al. |
| 4,437,829 | A | 3/1984 | Baker |

(Continued)

FOREIGN PATENT DOCUMENTS

| | | |
|---|---|---|
| EP | 0429359 | 5/1991 |

(Continued)

OTHER PUBLICATIONS

Canadian Patent Office, Office Action dated Sep. 4, 2009, Application No. 2,628,762, 2 pages.

*Primary Examiner*—Steven B McAllister
*Assistant Examiner*—Seth Greenia
(74) *Attorney, Agent, or Firm*—Haynes and Boone, LLP

(57) ABSTRACT

A fuel-fired water heater is provided with a premixing type main burner and an associated pilot burner for igniting it. A specially designed protective system is operative to detect a flame flashback burning condition in the main burner and responsively shut down the water heater. In one embodiment thereof, the protective system uses main burner body heat to melt a portion of a fuel supply line connected to the pilot burner during a flame flashback condition in the main burner. Such melting responsively causes an associated fuel supply valve to close and terminate water heater operation. In a second protective system embodiment a normally closed pressure switch is opened, thereby shutting down the water heater, when the switch detects a pressure indicative of a flame flashback condition in the main burner.

10 Claims, 4 Drawing Sheets

U.S. PATENT DOCUMENTS

| | | | | |
|---|---|---|---|---|
| 5,122,054 | A | 6/1992 | Debacque et al. | |
| 5,697,330 | A | 12/1997 | Yetman et al. | |
| 6,474,414 | B1 | 11/2002 | Gonzalez et al. | |
| 6,508,645 | B1 * | 1/2003 | George | 431/266 |
| 6,554,608 | B1 | 4/2003 | Bowman et al. | |
| 6,619,951 | B2 | 9/2003 | Bodnar et al. | |
| 6,923,263 | B2 | 8/2005 | Eden et al. | |
| 6,964,248 | B2 | 11/2005 | Stretch et al. | |
| 7,028,642 | B2 * | 4/2006 | Peart | 122/14.31 |
| 7,162,980 | B2 * | 1/2007 | Peart | 122/14.31 |

FOREIGN PATENT DOCUMENTS

| | | | |
|---|---|---|---|
| GB | 2093975 | A * | 9/1982 |

* cited by examiner

BURNER FLASHBACK DETECTION AND SYSTEM SHUTDOWN APPARATUS

BACKGROUND OF THE INVENTION

The present invention generally relates to combustion control apparatus for fuel-fired heating appliances and, in representatively illustrated embodiments thereof, more particularly provides apparatus for detecting a burner flashback condition in a fuel-fired appliance, representatively a water heater, and responsively shutting down combustion in the appliance.

Integration of fuel/air premixing type burners into fuel-fired water heaters has presented the potential for such burners operating at certain times and under certain conditions in a "flashback" burning mode in which the burner flame burns within the burner body instead of externally emanating therefrom as intended. It is possible for this flashback burning mode to continue for extended periods of time during which the burner can emit undesirably high levels of carbon monoxide and/or compromise the flammable ignition resistance system of the water heater.

Because of this potential for a flame flashback burning condition in a fuel burner incorporated in a fuel-fired heating appliance such as a water heater, it would be desirable to provide the appliance with a protective system operative to detect a burner flame flashback condition and responsively shut down the appliance.

SUMMARY OF THE INVENTION

In carrying out principles of the present invention, in accordance with representatively illustrated embodiments thereof, fuel-fired heating apparatus is provided which is representatively a gas-fired water heater, but may alternatively be another type of fuel-fired heating apparatus such as, by way of non-limiting example, a fuel-fired boiler or furnace.

In an exemplary embodiment thereof, the water heater comprises a tank adapted to hold a quantity of water to be heated, and a combustion chamber underlying the tank. A flue communicates with the combustion chamber and extends upwardly therefrom through the interior of the tank. The water heater further comprises a normally closed fuel supply valve, and main and pilot burners disposed in the combustion chamber, the main burner preferably being a fuel/air premixing type main burner having a body and being operative to burn a fuel/air mixture to form a flame emanating from the main burner. Alternatively, the main burner may be of a non-fuel/air premixing type. Main and pilot fuel supply lines are respectively connected between the main and pilot burners and the fuel supply valve.

According to a key aspect of the present invention, the water heater has incorporated therein a specially designed protective system which is operative to detect a flame flashback condition in the main burner and responsively shutdown operation of the water heater.

In one exemplary embodiment thereof, the protective system is operative to sense a temperature indicative of a flame flashback condition at the main burner and responsively shut down operation of the water heater. Illustratively, in this protective system embodiment a portion of the pilot fuel supply line is positioned to receive heat from the body of the main burner, and is melted by such heat when the body of the main burner reaches a temperature indicative of a flame flashback condition therein. Such melting of a portion of the pilot fuel supply line causes fuel flowing therethrough to the pilot burner to be discharged into the combustion chamber without being delivered to the pilot burner. This extinguishes the pilot burner flame which normally impinges upon and heats a thermocouple installed in a millivolt circuit thermoelectrically powered to hold the normally closed fuel supply valve in an open position. Extinguishment of the pilot burner flame permits the thermocouple to cool, thereby causing the fuel supply valve to terminate fuel flow to the main and pilot burners and thus shutting down water heater operation.

In another exemplary embodiment thereof, the protective system is operative to sense a pressure indicative of a flame flashback condition of the main burner and responsively shut down operation of the water heater. Illustratively, in this protective system embodiment a normally closed pressure switch is installed in the millivolt electrical circuit and has an inlet coupled to one end of a pressure-receiving conduit, the other end of which is positioned to receive the aforementioned pressure indicative of a flame flashback condition of the main burner. Such pressure-receiving end of the conduit may be communicated with the interior of the body of the main burner, the combustion chamber exteriorly of the main burner, or the flue. When a main burner flame flashback condition occurs, an increased pressure indicative of such flame flashback is transmitted through the pressure-receiving conduit to the normally closed pressure switch to open it, thereby opening the millivolt electrical circuit. The opening of the millivolt circuit, in turn, causes the open fuel supply valve to close, thereby shutting down operation of the water heater. Other types of pressure detection devices and locations thereof may alternatively be utilized, if desired, without departing from principles of the present invention.

DETAILED DESCRIPTION

Figure 1:
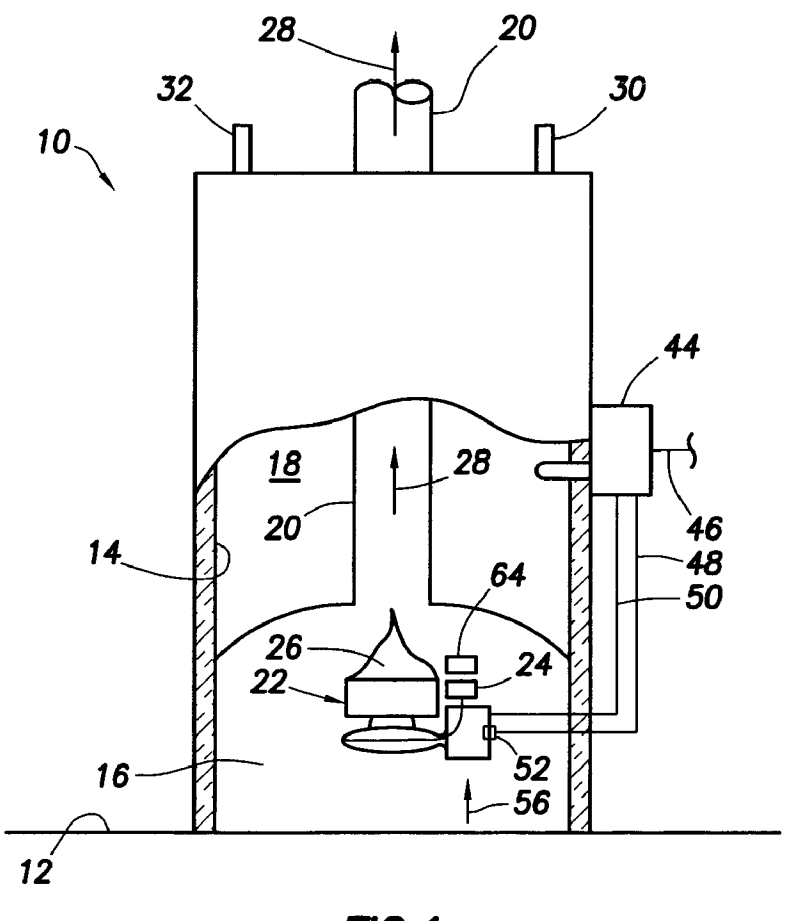
FIG. 1 is a schematic, partially elevational cross-sectional view through a fuel-fired water heater incorporating therein a protective burner flashback detection/combustion shutdown system embodying principles of the present invention.

Schematically depicted in partially cross-sectional form in FIG. 1 is a fuel-fired heating apparatus 10 which embodies principles of the present invention. Representatively, the apparatus 10 is a gas-fired water heater, but could alternatively be another type of fuel-fired heating apparatus such as, by way of non-limiting example, a boiler or a furnace.

Water heater 10 is supportable on a horizontal surface, such as a floor 12, and has an insulated tank 14 that overlies a combustion chamber 16 and is adapted to hold a quantity of pressurized water 18 to be heated. A flue 20 communicates at its lower end with the combustion chamber 16 and extends upwardly therefrom through the interior of the tank 14. Disposed within the combustion chamber 16, generally beneath the open lower end of the flue 20, are a main fuel burner 22 and an associated pilot fuel burner 24 operative in a conventional manner to ignite the main burner 22.

During firing of the water heater 10, a flame 26 emanates from the main burner 22, creating hot combustion products 28 that flow upwardly through the flue 20 and transfer combustion heat therethrough to the stored water 18. The interior of the tank 14 is typically communicated, via a hot water supply pipe 30, with various plumbing fixtures such as sinks, tubs, showers, dishwashers and the like which, on an on-demand basis, receive pressurized hot water from the interior of the tank 14. Hot water outflow from the tank 14 is automatically replaced therein with an inflow of pressurized cold water, from a source thereof, via a cold water inlet pipe 32.

Figure 3:
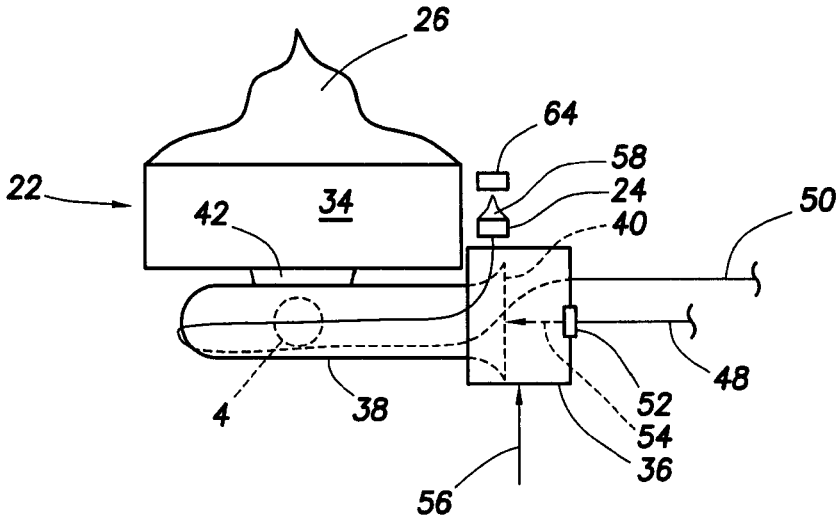
FIG. 3 is an enlarged scale side elevational view of a main/pilot burner portion of the water heater.

Referring now to FIGS. 1 and 3, the main burner 22 is representatively of a fuel/air premixing type, having a hollow body collectively defined by a main body portion 34 from which the flame 26 upwardly emanates, a premix plenum portion 36, and a mixer tube portion 38 extending between and communicating the interiors of the main body portion 34 and the premix plenum portion 36. As may be best seen in FIG. 3, an open inlet end portion 40 of the mixing tube 38 sealingly extends into the interior of the premix plenum 36 and has a bell-shaped venturi configuration, and an outlet end portion of the mixer tube 38 is coupled to the underside of the main body portion 34 by a hollow connecting structure 42.

A normally closed thermostatic fuel valve 44 is supplied at an inlet thereof with fuel (representatively a fuel gas) from a source thereof by a fuel supply line 46, and is respectively coupled at an outlet portion thereof to the main and pilot fuel burners 22,24 by fuel supply lines or conduits 48,50. Fuel supply line 48, at its discharge end, is operatively coupled to a fuel discharge orifice 52 mounted on a wall portion of the premix plenum 36.

During firing of the water heater 10, fuel 54 is discharged through the orifice 52 into the interior of the premix plenum 36 which simultaneously receives combustion air 56, representatively through its bottom side, from outside the water heater 10. Combustion air 56 may be ducted to the premix plenum 36 from outside the combustion chamber 16, or may be suitably introduced into the combustion chamber 16 and permitted to flow, unducted, into a suitable air inlet opening in the premix plenum 36. Fuel 54 and air 56 entering the premix plenum 36 flow therefrom into the mixing tube 38 where they are mixed to form a fuel/air mixture which enters the main burner body portion 34 and then upwardly exits therefrom, for initial ignition by a pilot flame 58 issuing from the pilot burner 24, to form the main burner flame 26.

Under certain conditions, a flame flashback condition may occur at the main burner 22. If this occurs, the flame 26 undesirably burns within the interior of the hollow body of the main burner 22 instead of burning externally thereto as designed for. According to a key feature of the present invention, a specially designed protective system is built into the water heater 10 and is operative, as will now be described, to detect this undesirable flame flashback burning condition at the main burner 22 and responsively terminate operation of the water heater 10.

Figure 2:
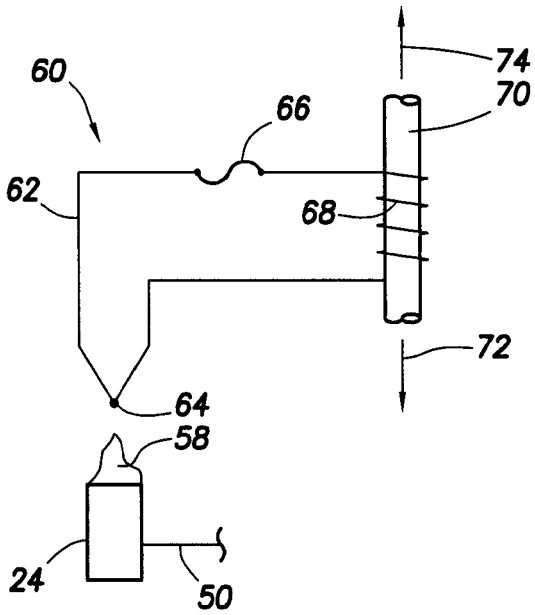
FIG. 2 is a simplified diagram of a fuel valve millivolt electrical control circuit portion of the system.
Figure 4:
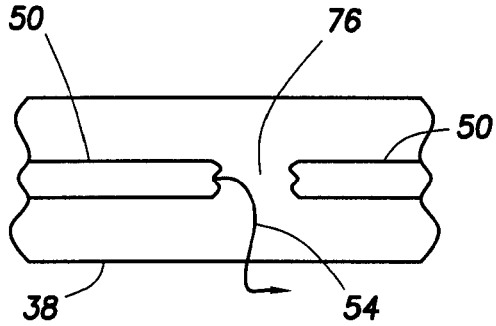
FIG. 4 is an enlarged detail view of the dashed area "4" in FIG. 3 illustrating the operation of a meltable pilot fuel supply line portion of the system.

With reference now to FIGS. 2-4, the protective system representatively comprises a portion of the pilot fuel supply line 50, a millivolt electrical circuit 60 (see FIG. 2), and the pilot burner 24. As may best be seen in FIG. 3, a longitudinal portion of the pilot fuel supply line 50 is horizontally wrapped around the burner mixer tube portion 38 of the overall body of the main fuel burner 22 and is in direct contact with its outer surface. The millivolt circuit 60 is of a conventional construction and operation and includes circuit wiring 62 in which are series-connected a thermocouple 64 (or other suitable thermoelectric device) positioned to be impinged upon by the pilot flame 58, a conventional high limit ECO switch structure 66, and a solenoid winding 68 that encircles a longitudinally movable metal rod portion 70 of the fuel valve 44 (see FIG. 1).

Representatively, the rod 70 is spring-biased downwardly, as indicated by the arrow 72 in FIG. 2, to hold the valve 44 in its normally closed position. However, during impingement of the pilot flame 58 on the thermocouple 64 the thermocouple creates a thermoelectric current in the circuit wiring 62 that in turn creates, via the solenoid winding 68, an upwardly directed electromagnetic force on the rod 70 that drives it upwardly, as indicated by the arrow 74 in FIG. 2, to open the fuel valve 44 and hold it open until the thermocouple cools in response to a termination of the pilot flame 58.

During normal firing of the main burner 22, the maximum temperature of its hollow body 34,36,38 is on the order of about 600 degrees Fahrenheit. However, when a flame flashback condition occurs at the main burner 22, its body temperature increases to approximately 1250 degrees Fahrenheit or above. The present invention uniquely takes unique advantage of this significant burner body temperature rise during a flame flashback burning condition at the main burner 22 by forming at least the portion of the pilot fuel supply line 50 which is in direct contact with the body of the main burner 22 of a material which melts at an elevated temperature of the burner body which is indicative of a flame flashback condition at the main burner 22. Illustratively, such portion of the pilot burner fuel supply line 50 is formed from an aluminum material having a melting point of approximately 1200 to 1250 degrees Fahrenheit.

Referring now to FIG. 4, when the mixer tube portion 38 of the main burner 22 reaches an elevated temperature indicative of a flame flashback burning condition in the burner body, heat transferred from the burner body to the portion of the pilot burner fuel supply line 50 contacting it, thereby forming a gap or sidewall opening 76 in the line 50 which permits fuel 54 flowing through the line 50 toward the pilot burner 24 to escape from the line 50 into the combustion chamber 16 before such fuel reaches the pilot burner 24. In turn, this extinguishes the pilot burner flame 58, permitting the thermocouple 64 to cool. By the usual operation of the conventional fuel valve 44, this in turn terminates fuel flow through both of the fuel supply lines 48 and 50, thereby shutting down operation of the water heater 10.

Figure 5:
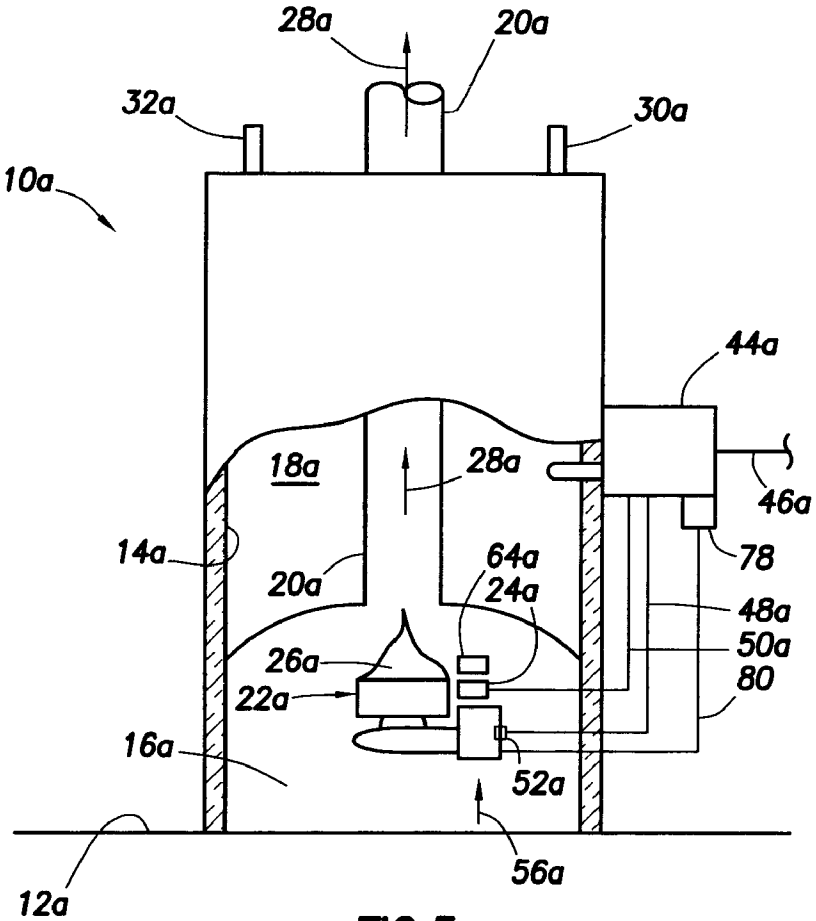
FIG. 5 is a schematic, partially elevational cross-sectional view through an alternate embodiment of the fuel-fired water heater of FIG. 1.

An alternate embodiment 10*a* of the previously described water heater 10 is schematically illustrated in FIG. 5. To facilitate the ready comparison of water heaters 10 and 10*a*, components in the water heater 10*a* similar to those in water heater 10 have been given the same reference numerals, but with the subscripts "a".

Water heater 10*a* is substantially identical to the previously described water heater 10 with the exception that its flame flashback protective system is not activated by burner body heat, but is instead operative to sense a pressure indicative of a flame flashback burning condition at the main burner 22*a*, and responsively shut down operation of the water heater 10*a*.

Figure 6:
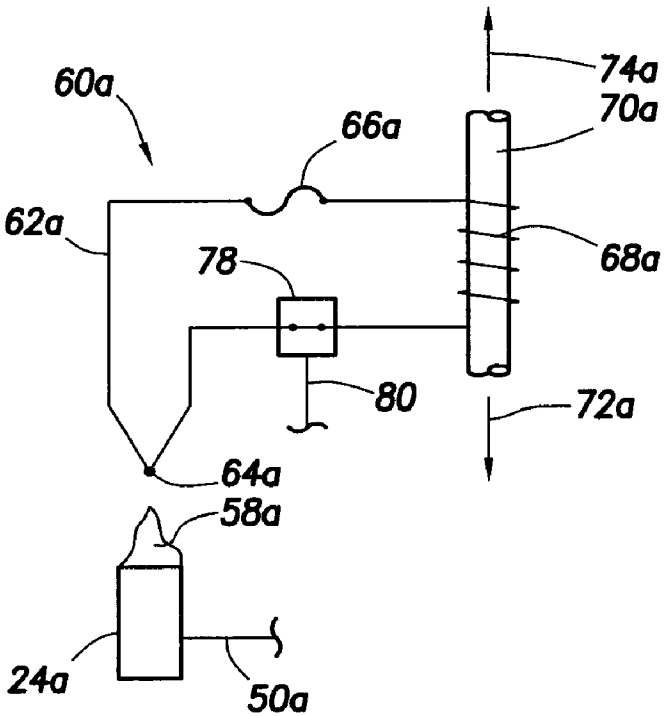
FIG. 6 is a simplified diagram of a fuel valve millivolt electrical control circuit portion of an alternate protective burner flashback detection/combustion shutdown system embodiment incorporated in the FIG. 5 water heater.

This pressure-based flame flashback protection is representatively achieved in the water heater 10*a* by providing a normally closed electrical pressure switch 78 (see FIG. 6) connected as shown in the millivolt electrical circuit 60*a* in series with the thermocouple 64*a*, the ECO switch 66*a* and the fuel supply valve solenoid winding 68*a*. A pressure sensing line 80 is coupled at one end thereof to the inlet of the pressure switch 78, with the other end of the line 80 being positioned in the water heater 10*a* to be exposed to a pressure indicative of a flame flashback burning condition in the main fuel burner 22*a*.

Figure 7:
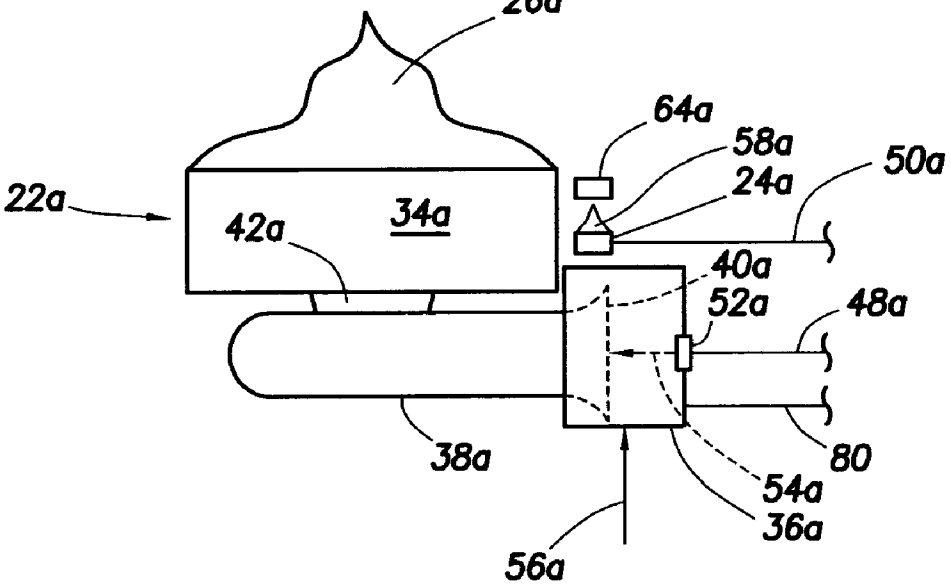
FIG. 7 is an enlarged scale side elevational view of a main/pilot burner portion of the FIG. 5 water heater.

As can be seen in FIGS. 5 and 7, the open pressure-receiving end of the pressure sensing line 80 is representatively coupled to the interior of the premix plenum portion 36*a* of the main burner 22*a*. During a flame flashback burning condition at the main burner 22*a*, a resulting pressure increase in the premix plenum portion 36*a* is transmitted via line 80 to the normally closed pressure switch 78 (FIG. 6) and opens the switch 78, thereby opening the millivolt circuit 60*a*. This circuit opening terminates current flow through the valve solenoid winding 68*a* which, in turn, permits the valve rod 70*a* to move downwardly, as indicated by the arrow 72*a* in FIG. 6, and close the fuel supply valve 44*a* (FIG. 5), thereby shutting down the operation of the water heater 10*a*.

Figure 9:
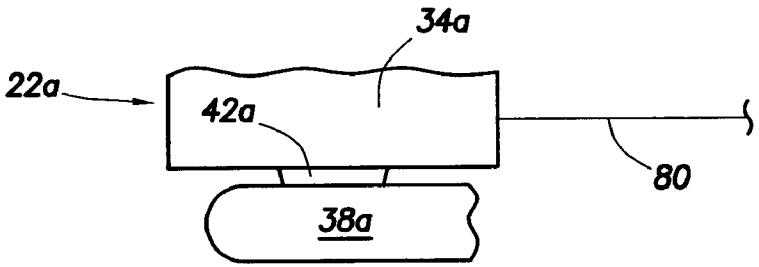
FIG. 9 is a schematic fragmentary side elevational view showing a second representative alternate location of the inlet of a pressure sensing line portion of the burner flashback detection/combustion shutdown system incorporated in the FIG. 5 water heater.
Figure 8:
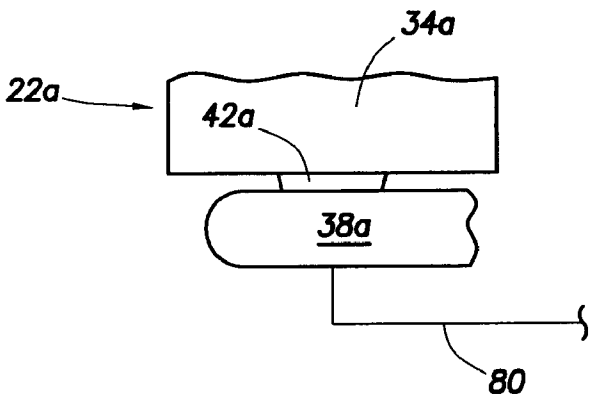
FIG. 8 is a schematic fragmentary side elevational view showing a first representative alternate location of the inlet of a pressure sensing line portion of the burner flashback detection/combustion shutdown system incorporated in the FIG. 5 water heater.
Figure 11:
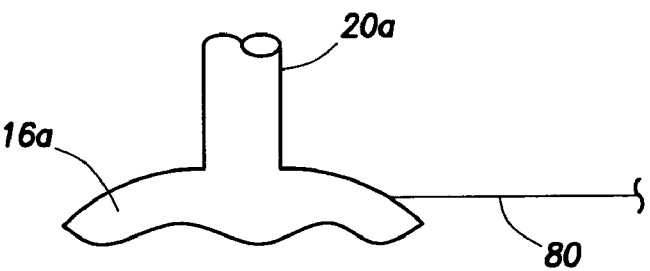
FIG. 11 is a schematic fragmentary side elevational view showing a fourth representative alternate location of the inlet of a pressure sensing line portion of the burner flashback detection/combustion shutdown system incorporated in the FIG. 5 water heater.
Figure 10:
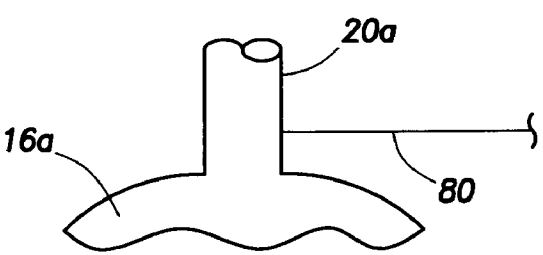
FIG. 10 is a schematic fragmentary side elevational view showing a third representative alternate location of the inlet of a pressure sensing line portion of the burner flashback detection/combustion shutdown system incorporated in the FIG. 5 water heater.

While the inlet end of the pressure sensing line 80 is illustratively communicated with the interior of the premix plenum portion 36*a* of the main burner 22*a*, the inlet end of the line 80 may alternatively be positioned in various other locations in the water heater 10*a* to detect a pressure indicative of a flame flashback burning condition at the main fuel burner 22*a*. For example, the inlet of the pressure sensing line 80 may be communicated with the interior of the burner mixer tube 38*a* (FIG. 8), the interior of the main body portion 34*a* (FIG. 9), the interior of the flue 20*a*, preferably near the combustion chamber 16*a* (FIG. 10), or the interior of the combustion chamber 16*a* exteriorly of the main burner 22*a* (FIG. 11).

A variety of modifications could be made to the exemplary fuel-fired heating appliances 10, 10*a* described above without departing from principles of the present invention. For example, as previously mentioned herein, they could be fuel-fired heating appliances or apparatus other than water heaters—for example, boilers or furnaces. Additionally, in the water heater embodiment 10, the entire pilot fuel supply line 50 could be of a material which is meltable at a temperature indicative of the sensed flame flashback burning condition in the main burner 22 instead of forming only the portion of the fuel supply line 50 positioned against the body of the burner 22 from such material.

Alternatively, a suitable meltable material insert could be placed in an appropriate side wall portion of the fuel supply line 50, or a heat-movable opening member could be operatively incorporated in a side wall opening of the line 50. Various other mechanisms could also be employed to create an opening in the overall pilot fuel supply line structure, to permit fuel being supplied therethrough to the pilot burner 24 to escape from such fuel line structure before reaching the pilot burner, in response to exposure of at least a portion of the pilot fuel supply line structure to a temperature indicative of a flame flashback burning condition in the main fuel burner 22. Moreover, while the main burners 22,22*a* respectively incorporated in the water heaters 10,10*a* are illustratively premixing type fuel burners, it will be readily appreciated by those of skill in this particular art that principles of the present invention may also be utilized to advantage in conjunction with non-premixing type fuel burners as well.

In the alternate pressure detection embodiment 10*a* of the water heater 10, the normally closed pressure switch 78 is representatively connected in the millivolt circuit 60*a* as previously described herein. However, as will be readily appreciated by those of skill in this particular art, other types of pressure detection devices and/or other locations therefor may, if desired, be alternatively utilized to detect a pressure indicative a burner flame flashback condition without departing from principles of the present invention.

The foregoing detailed description is to be clearly understood as being given by way of illustration and example only, the spirit and scope of the present invention being limited solely by the appended claims.

What is claimed is:

1. Fuel-fired heating apparatus comprising:

a first burner having a body through which fuel may be flowed for combustion with air to create a flame emanating from said first burner;

a second burner disposed externally of said first burner; and a fuel line structure through which fuel may be flowed to said second burner, said fuel line structure having a portion which is openable, in response to a portion of said body of said first burner reaching a predetermined temperature elevated above a normal firing temperature indicative of a flame flashback condition in said first burner, to permit fuel flowing through said fuel line structure to escape therefrom before reaching said second burner, said fuel line structure being disposed entirely external to said first burner said portion of said fuel line structure is positioned to receive heat from said portion of said body of said first burner and is meltable thereby when the temperature of said portion of said body of said first burner reaches said predetermined elevated temperature indicative of a flame flashback condition in said first burner; said fuel line structure includes a fuel supply conduit; said meltable portion of said fuel line structure is a longitudinal portion of said fuel supply conduit; and said longitudinal portion of said fuel supply conduit is in direct external contact with said body of said first burner.

2. The fuel-fired heating apparatus of claim 1 wherein:

said fuel-fired heating apparatus is a water heater.

3. The fuel-fired heating apparatus of claim 2 wherein:

said water heater is a gas-fired water heater.

4. The fuel-fired heating apparatus of claim 1 wherein:

said fuel-fired heating apparatus has a combustion chamber;

said first and second burners are disposed in said combustion chamber; and said portion of said fuel line structure is disposed within said combustion chamber.

5. The fuel-fired heating apparatus of claim 1 wherein:

said portion of said fuel line structure is in direct thermal contact with said portion of said body of said first burner.

6. The fuel-fired heating apparatus of claim 1 wherein:

said longitudinal portion of said fuel supply conduit is meltable at a temperature within the range of from about 1200 degrees Fahrenheit to about 1300 degrees Fahrenheit.

7. The fuel-fired heating apparatus of claim 1 wherein:

said fuel supply conduit is formed from an aluminum material.

8. The fuel-fired heating apparatus of claim 1 further comprising:

a normally closed fuel valve operatively coupled to said first burner and said fuel line structure and operative to supply fuel to said first and second burners, and a millivolt electrical circuit operatively coupled to said fuel valve, said circuit containing therein a thermoelectric structure positioned to be impinged upon by a flame emanating from said second burner, the flame-heated thermoelectric structure generating an electric current in said circuit which holds said valve open until said thermoelectric structure is permitted to cool.

9. The fuel-fired heating apparatus of claim 1 wherein:

said first burner is a fuel/air premixing type main burner, and said second burner is a pilot burner operatively associated with said main burner.

10. A fuel-fired water heater comprising:

a tank adapted to hold a quantity of water to be heated;

a combustion chamber underlying said tank;

a flue communicating with said combustion chamber and extending upwardly therefrom through the interior of said tank;

a normally closed fuel supply valve;

a fuel/air premixing type main burner disposed within said combustion chamber and having a body, said main burner being operative to burn a fuel/air mixture to form a flame emanating from said main burner;

a first fuel supply line operatively interconnected between said fuel supply valve and said main burner;

a pilot burner disposed within said combustion chamber externally of said main burner and operative to burn fuel and air and create a pilot flame useable to ignite said main burner;

a second fuel supply line operatively interconnected between said fuel supply valve and said pilot burner; and a millivolt circuit operatively connected to said fuel supply valve and having a thermoelectric structure heatable by said pilot flame to hold said normally closed fuel supply valve open, said second fuel supply line having a portion disposed against a portion of said body of said main burner and being meltable by said portion of said body, when said portion of said body reaches temperature elevated above a normal temperature and indicative of a flame flashback burning condition in said main burner, to release to said combustion chamber fuel flowing through said second fuel supply line before the fuel reaches said pilot burner, said second fuel supply line being entirely external to said main burner.

* * * * *